US005363010A

United States Patent [19]

Van Mensvoort

[11] Patent Number: 5,363,010

[45] Date of Patent: Nov. 8, 1994

[54] COLOR DISPLAY TUBE HAVING AN INTERNAL MAGNETIC SHIELD

[75] Inventor: Adrianus J. Van Mensvoort, Eindhoven, Netherlands

[73] Assignee: U.S. Philips Corporation, New York, N.Y.

[21] Appl. No.: 874,254

[22] Filed: Apr. 24, 1992

[30] Foreign Application Priority Data

Apr. 29, 1991 [EP] European Pat. Off. ..... 91201024.7

[51] Int. Cl.[5] ..... H01J 29/06

[52] U.S. Cl. ..... 313/402; 313/443; 313/479

[58] Field of Search ..... 313/402, 407, 431, 433, 313/479, 443, 326; 445/22

[56] References Cited

U.S. PATENT DOCUMENTS

| | | | |
|---|---|---|---|
| 4,229,675 | 10/1980 | Matsuki et al. | 313/479 |
| 4,580,076 | 4/1986 | Shimoma et al. | 313/479 |
| 4,622,490 | 11/1986 | Benway | 313/402 |
| 4,758,193 | 7/1988 | Brown | 313/479 |
| 4,845,402 | 7/1989 | Smith | 313/422 |
| 4,882,516 | 9/1989 | Hirata et al. | 313/402 |
| 5,081,392 | 1/1992 | Alig | 313/402 |
| 5,097,174 | 3/1992 | D'Amato | 313/402 |

FOREIGN PATENT DOCUMENTS

| | | | |
|---|---|---|---|
| 53-16575 | 2/1978 | Japan | 313/402 |

*Primary Examiner*—Donald J. Yusko
*Assistant Examiner*—Vip Patel
*Attorney, Agent, or Firm*—Paul R. Miller

[57] ABSTRACT

A color display tube is described of the 3-in-line type having a display screen with a stripe-shaped phosphor pattern. The display tube has an internal magnetic shield with a scanning aperture at its gun-sided end for electron beams produced by the electron gun and scanning the display screen. This scanning aperture extends into the short side walls of the shield in a pair of diametrically extreme points at each side to form an oversized scanning aperture with two, and the aperture has a ratio from 1.5 to 1.75 standardized in accordance with the aspect ratio between the long central axis and the short central axis.

7 Claims, 5 Drawing Sheets

COLOR DISPLAY TUBE HAVING AN INTERNAL MAGNETIC SHIELD

The invention relates to a color display tube comprising:

an envelope with a longitudinal axis, and the envelope having a neck portion, a funnel shaped portion and a window portion;

an electron gun arranged in the neck portion;

an elongated display screen having an aspect ratio $\alpha$ and a pattern of phosphor lines parallel to an axis of the display screen on the inner surface of the window portion;

a color selection means arranged within the envelope adjacent to the display screen;

an internal magnetic shield arranged within the funnel-shaped portion, which shield has two long walls parallel to the long axis of the display screen and two short walls parallel to the short axis of the display screen and a rectangular aperture at its gun-sided end, which aperture extends transversely to the longitudinal axis and constitutes a scanning aperture for electron beams produced by the gun and scanning the display screen.

A color selection means is herein understood to mean, for example, an apertured shadow mask sheet or a wire mask.

The aspect ratio $\alpha$ is understood to mean the dimension of the long central axis divided by the dimension of the short central axis of the display screen. The aspect ratio thus characterizes the picture format.

BACKGROUND OF THE INVENTION

In a color display tube the earth's magnetic field deflects electron paths, which deflections without any correcting measures may be so large that the electrons impinge upon the wrong phosphor, i.e. a mislanding, and produce a discoloration of the displayed picture. Particularly the component of the earth's magnetic field in the direction of the axis of the display tube (commonly referred to as the axial field) plays an important role in this respect, which may become manifest as a lack of color or even as color impurity in the corners of the display screen.

A known measure of reducing mislandings due to the earth's magnetic field is the use of an internal magnetic shield. The shape of such a shield, which is usually made of iron, roughly follows the contours of the envelope of the display tube. This means that the funnel-shaped shield has two long trapezoidal walls which are parallel to the long axis (the x axis) of the display screen and two short trapezoidal walls which are parallel to the short axis (the y axis) of the display screen.

The short sides of the shield are often provided with a V-shaped recess at the gun side so as to reduce mislandings in the corners due to the axial field. When relatively small tubes and a relatively large pitch of the pixels of the phosphor line pattern on the display screen are used, an acceptable result is achieved in this way. When larger display tubes and/or a smaller pitch of the phosphor pixels are used, this type of solution does not, however, guarantee a sufficient color purity. The invention is based on the recognition that mislandings due to the vertical component of the earth's magnetic field is increased because the short sides are provided with V-shaped recesses and that this effect is more serious as the size of the V-shaped recesses increases (which size depends on the strength of the earths magnetic axial field to be compensated).

SUMMARY OF THE INVENTION

It is an object of the present invention to provide an embodiment of a shield yielding the same improvement with respect to the axial magnetic field as a shield having V recesses, but with a smaller increase of the detrimental effect of the vertical field.

It is another object of the present invention to provide an embodiment of a shield which, as regards the detrimental effect of the axial field on the color purity in the corners, is better than a shield having V recesses without the detrimental effect of the vertical field increasing to a notable extent.

According to the invention, a display tube of the type described in the opening paragraph is therefore characterized in that the scanning aperture at the end toward the electron gun extends into the two side walls parallel to the short axis of the display screen so that an oversized aperture is formed with 2 pairs of diametrically opposed extreme angular points at opposite sides of the aperture, and with a long central axis of the aperture having a length a and a short central axis having a length b, satisfying the condition:

$$1.5 \leqq 1/\alpha \times a/b \leqq 1.75.$$

where $\alpha$is the aspect ratio of the display screen.

In this form the iron cross-section of the shield remains maximum for the vertical field so that the shielding from the vertical earth's magnetic field remains optimally intact and the mislandings remain limited. In the proposed construction the surface of the apertures may be comparable in size with the V recesses so that a desired parasitic magnetic field at the east and west sides (the short sides) can penetrate to a comparable extent. These parasitic magnetic fields produce a spot displacement which, as with the V recesses, can compensate for mislandings in the corners. The invention is thus based on recognition that the iron cross-section of the shield is optimized. In this respect it is advantageous if the scanning aperture laterally widens in the short walls of the shield.

The shield is preferably formed in such a way that the scanning aperture widens along its diagonals in the shield walls parallel to the short axis of the display screen (see FIG. 8).

A further embodiment is characterized in that the scanning aperture merges into fishtail-shaped apertures extending in the shield walls parallel to the short axis of the display screen.

This embodiment particularly provides the possibility of giving the shield a central cross-section which is substantially equal to the cross-section between two diametrically opposed extreme angular points of the oversized aperture and the oppositely located angular points of the shield.

The effect of the special shape of the maximum aperture on the "iron cross-section" can be further enhanced if the shield is made of a material having a thickness $d \geqq \frac{1}{4} D \times 10^{-3}$ mm, in which D is the picture diagonal, and/or if the shield is made of a material having a coercive force $H_c \leqq 170$ A/m. When using a material having a coercive force $H_c \leqq 130$ A/m, in (particular $\leqq 100$ A/m, a material thickness $d \geqq 1/5\ D \times \mathbf{10}^{-3}$ mm may be chosen, which is advantageous if D is large. It is advantageous if the shield has a skirt (as shown in FIG. 8) at its screen side, which skirt follows the contour of the shadow mask at least along the short sides. The iron cross-section of the shield (i.e the cross-section in the areas P, P', see FIG. 4*a*) is enlarged by this measure.

BRIEF DESCRIPTION OF THE DRAWINGS

These and other aspects of the invention will be described in greater detail with reference to the accompanying drawings in which

FIGS. 5*a* and 5*b* are prior art representations.

DESCRIPTION OF THE INVENTION

Figure 1:
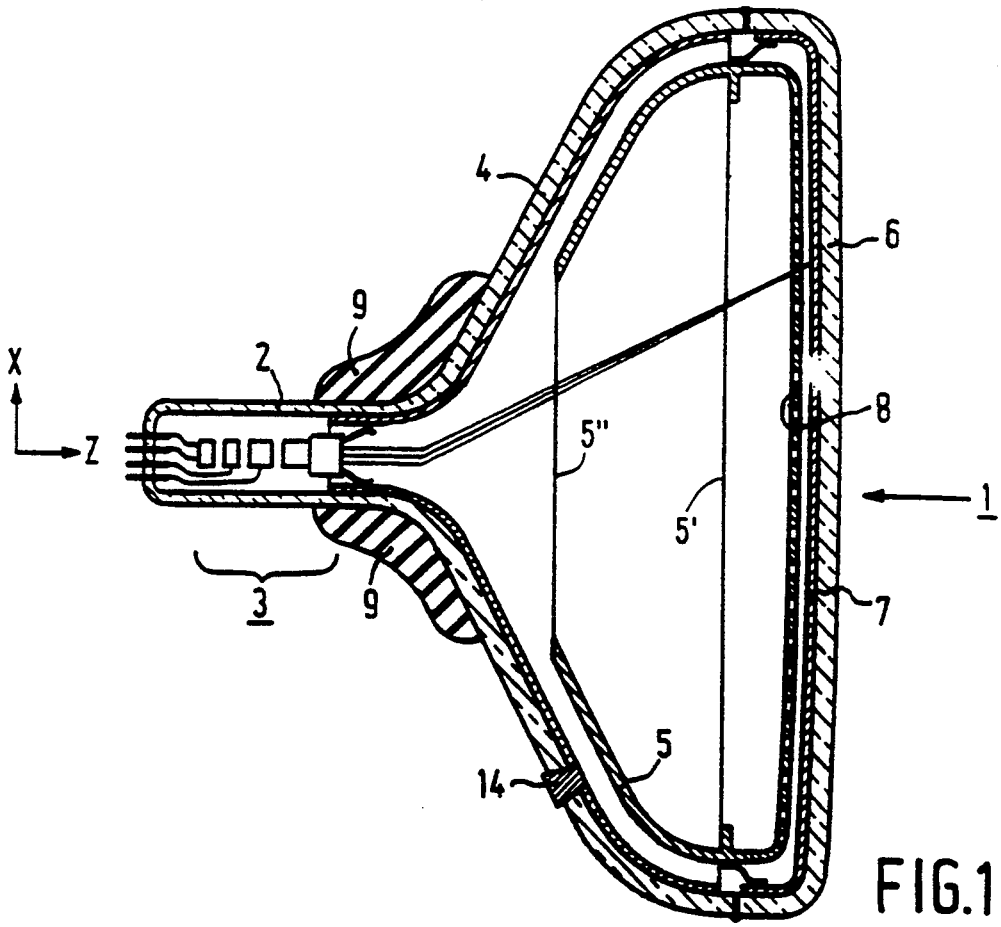
FIG. 1 is a longitudinal sectional view of a color display tube.
Figure 2:
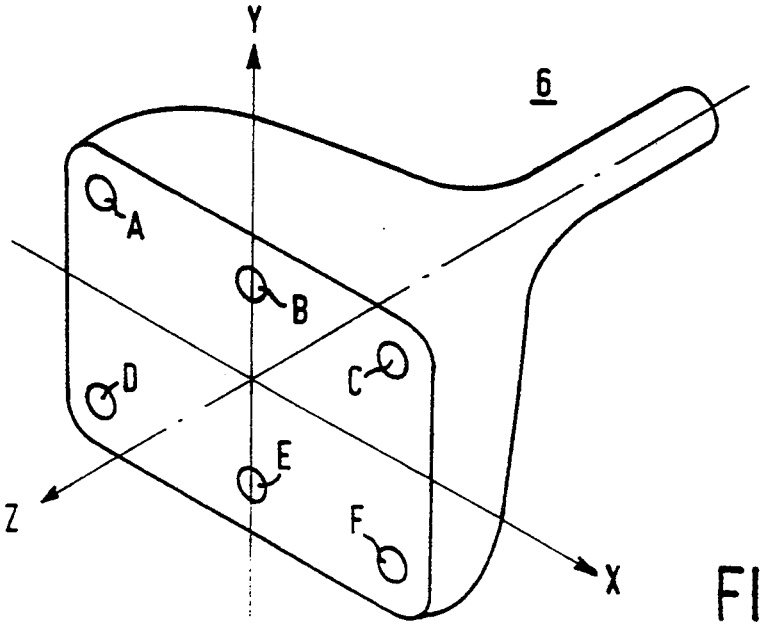
FIG. 2 is a diagrammatic perspective elevational view of a color display tube, showing a system of coordinates and the display screen positions where beam mislandings are measured.

FIG. 1 shows a color display tube 1 having a glass envelope which comprises a neck portion 2 accommodating an electron gun system 3, a funnel-shaped portion 4 within which a magnetic shield 5, having front and rear edges 5' and 5'', is arranged and a window portion 6 whose inner surface is provided with a display screen 7. A shadow mask 8 is arranged between the magnetic shield 5 and the display screen 7.

Figure 3A:
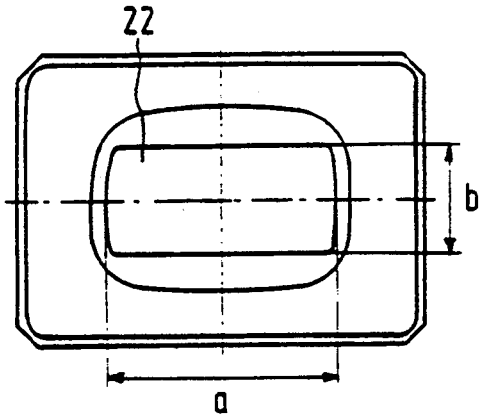
FIG.3a PRIOR ART
FIG. 3*a* is an elevational view of a prior art internal shield.
Figure 3B:
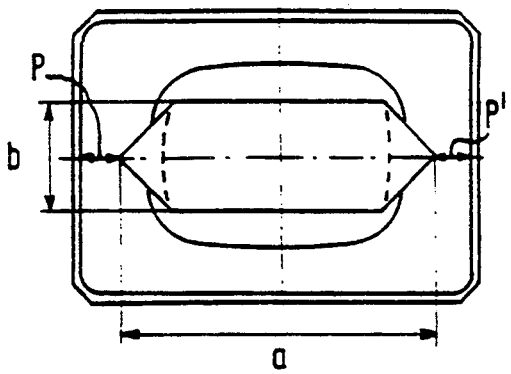
FIG.3b PRIOR ART
FIG. 3*b* is an elevational view of a prior art internal shield.
Figure 5A:
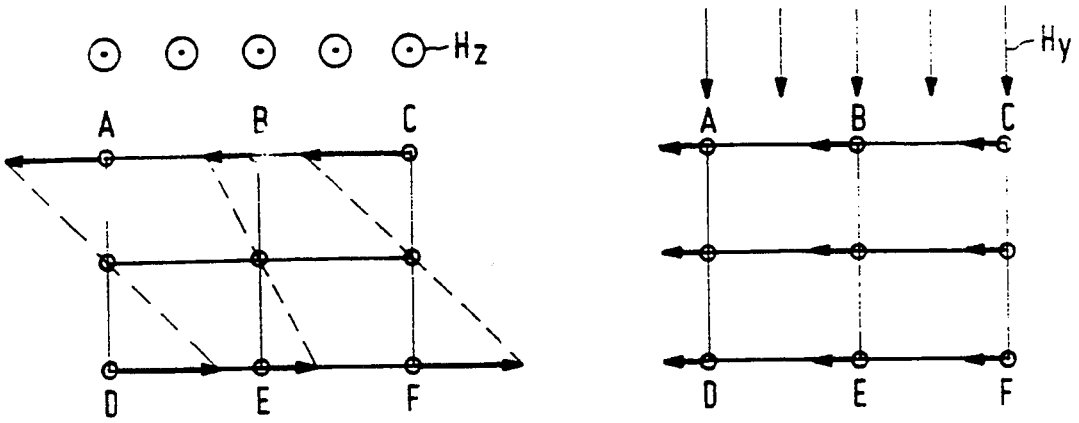
FIG.5a PRIOR ART
FIGS. 5*a*, 5*b* and 5*c* are diagrammatic representations to explain the beam mislandings on the display screen due to the earth's magnetic field where

The shape of a conventional prior art magnetic shield in a display tube such as 1, roughly follows the contours of the funnel-shaped portion (see FIG. 3*a*). Under the influence of a vertical (Hy) and an axially (Hz) directed earth's magnetic field a mislanding pattern as is shown in FIG. 5*a* is produced on the screen. This produces color impurity in the corners of the display screen, particularly in the case of an axial magnetic field. By providing a V aperture at the opposite side walls of the shield (see FIG. 3*b*), the mislanding in the corners can be reduced. The aperture at the thus produced end has one pair of extreme diametrically angular points.

Figure 5B:
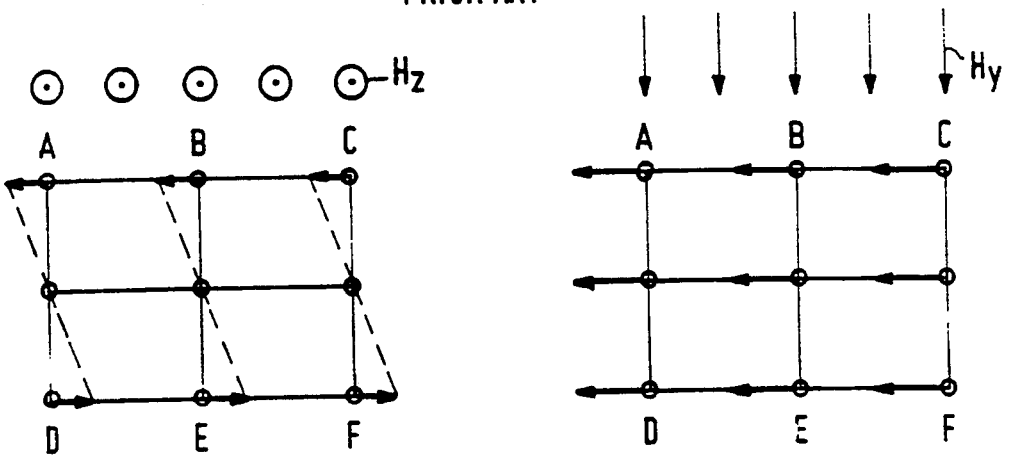
FIG.5b PRIOR ART

A drawback of such V apertures is, however, that mislanding are increased in the case of the vertical magnetic field Hy (see FIG. 5*b*).

Figure 4A:
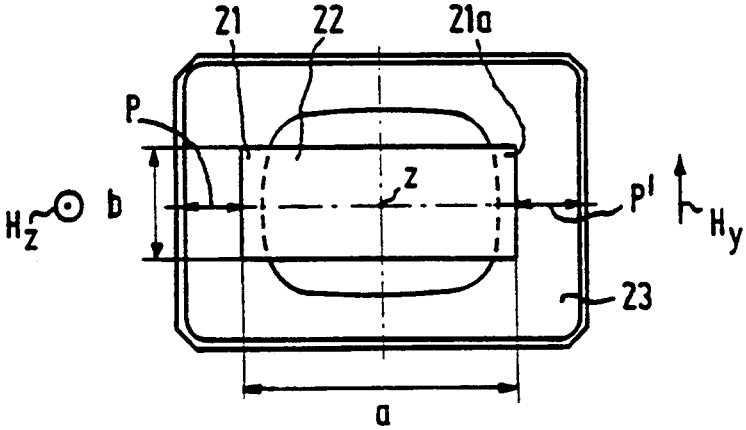
FIG. 4*a* is a front elevation of a first embodiment of a shield according to the invention.
Figure 5C:
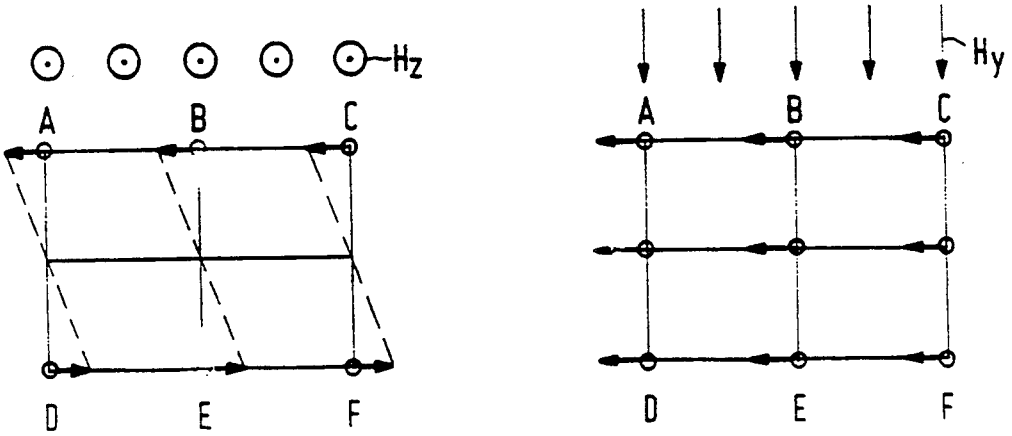

The invention is based on the recognition that specially dimensioned pairs of vertically oriented field correction apertures are provided in both the east and west sides of the shield (see FIG. 4*a*) instead of singular horizontally directed V recesses. The effect of this is shown in FIG. 5*c*. These apertures 21, 21*a* ensuring an oversized scanning aperture 22 are dimensioned in FIG. 4*a* in such a way that the material cross-section of the shield 23 in the areas p, p' (the "central iron cross-section") for the vertical field $H_y$ is as favorable as possible, while the ratio between the dimensions of the long central axis a and the short central axis b of the oversized aperture is such that the axial magnetic field $H_z$ is optimally compensated. The ratio a/b has a relation to the aspect ratio $\alpha$ of the display screen. It is found that the value $a/b \times 1/\alpha$ must be between 1.50 and 1.75 so as to achieve the desired result. A value of 1.60 is optimal in many cases. The range of values for $a/b \times 1/\alpha$ applies, for example, to tubes having a display screen with a 4:3 aspect ratio (see FIG. 6) and to (HDTV) tubes having a display screen with a 16:9 aspect ratio (see FIG. 7).

Figure 4B:
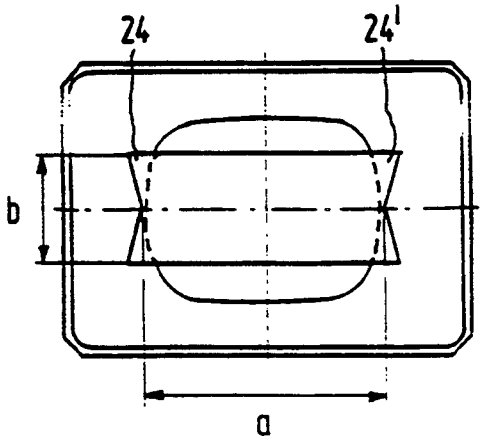
FIGS. 4*b*and 4*c* show second and third embodiments of a shield according to the invention.
Figure 4C:
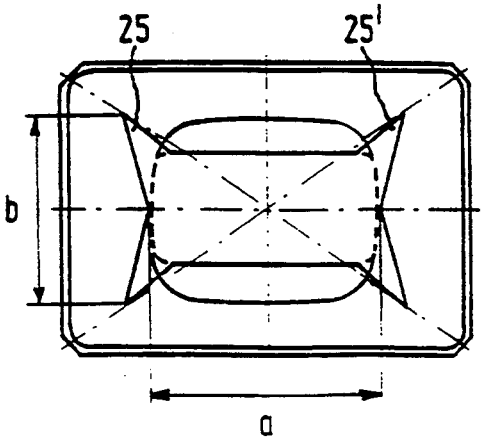

FIGS. 4*b* and 4*c* are rear elevations of shields having "field correction" apertures which are optimized to a further extent. FIG. 4*b* shows apertures 24 and 24' with an M-shaped configuration. FIG. 4*c* shows field correction apertures with a more pronounced fishtail-shaped M configuration.

The following Table shows some comparative measuring results.

The Table shows for different shields in a 66FS 110° narrow neck tube the occurring beam displacements (in microns) in the corners due to the vertical magnetic field $H_y$ and the axial magnetic field $H_z$.

TABLE

| Shield Type | Vertical Corners (microns) | Axial Corners (microns) |
|---|---|---|
| standard (FIG. 3a) | 7.5 | 9 |
| V-apertures (FIG. 3b) | 18 | 7.5 |
| U-apertures (FIG. 4a) | 15 | 5.5 |
| | 5 | 0 |
| M-apertures (FIG. 4b) | 16 | 6 |
| | 22 | 4.5 |
| FT-apertures (FIG. 4c) | 7 | 0 |

In the case of the U apertures and the FT apertures the result mentioned in the upper row refers to a shield having a material thickness of 0.15 mm (as have also the other shields). The result mentioned in the lower row relates to a shield having a material thickness of 0.20 mm.

Figure 6:
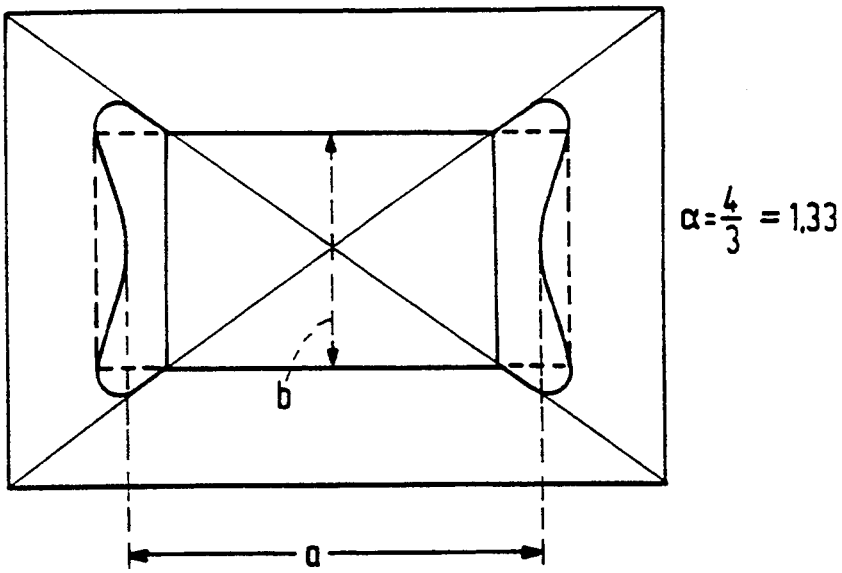
FIGS. 6 and 7 are diagrammatic rear views of shields for display tubes according to the invention, with aspect ratios of 1.33 and 1.78, respectively.

For performing measurements a shield of the type diagrammatically shown in FIG. 6 was made for a 66FS display tube having a display screen aspect ratio of 1.33. The ratio a/b was brought to 2.13, as against 1.86 for the conventional type, so that $1/\alpha \times a/b$ was equal to 1.60 (as against 1.40 for the conventional shield). Very good results were achieved with this shield.

Figure 7:
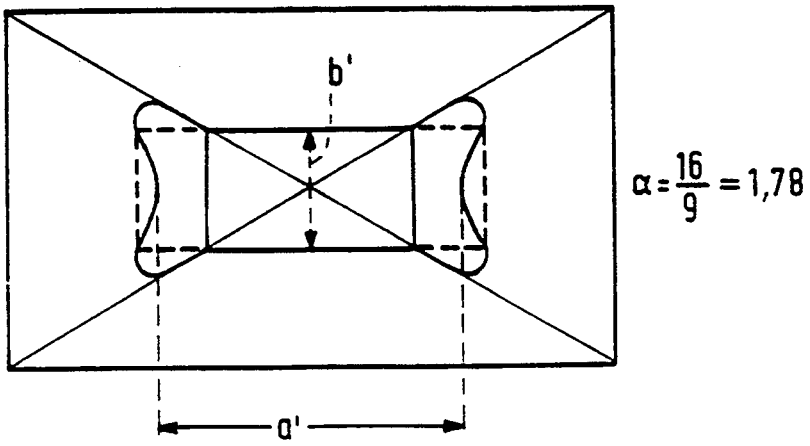

For performing measurements, a shield of the type diagrammatically shown in FIG. 7 was manufactured for a 36WS display tube with a display screen aspect ratio of 1.78. The ratio a/b was brought to 2.8, as against 2 for the conventional type so that $1/\alpha \times a/b$ was equal to 1.59 (as against 1.12 for the conventional shield). Very good results were achieved with this shield. At values of $1/\alpha \times a/b$ of more than 1.75 the central cross-section of the shield material becomes too small for the envisaged result.

At values below 1.50 the influence of the axial magnetic field is too large for the envisaged result.

Figure 8:
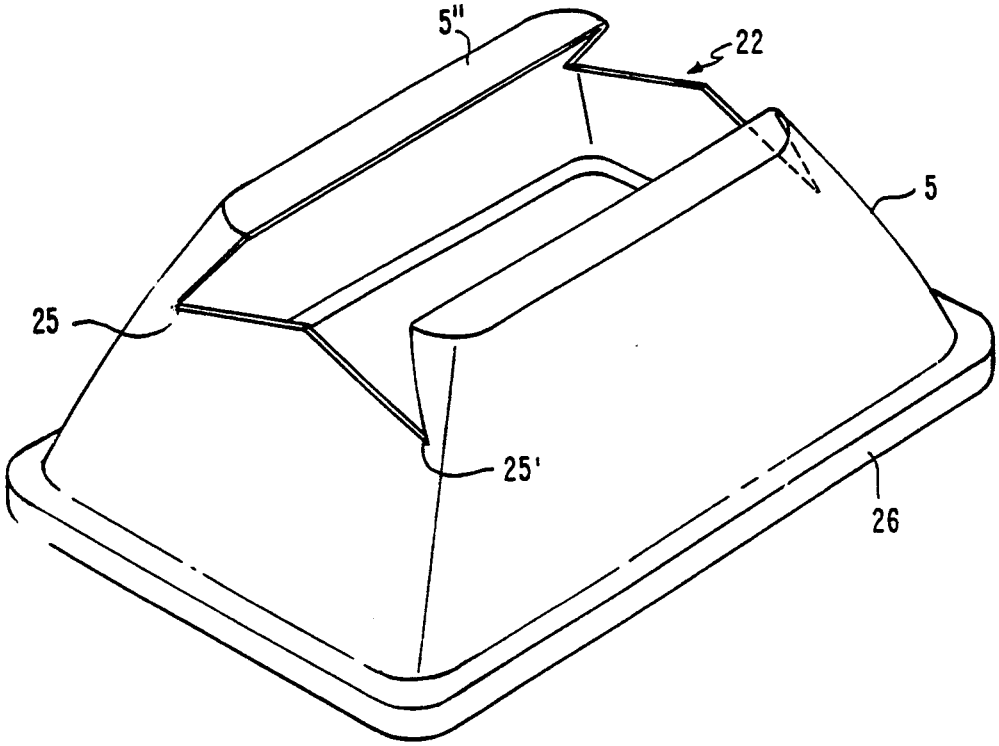
FIG. 8 is a perspective, elevational view of the magnetic shield according to the invention having a field correction aperture similar to FIG. 4*c*.

FIG. 8 shows a perspective, elevational view a of a magnetic shield 5 according to the invention. At the rear edge 5'', a scanning aperture 22 having fishtail-shaped apertures 25, 25' (as in FIG. 4*c*) is provided. Thus, the magnetic shield widens along its diagonals in the shield walls parallel to the short axis of the display screen. Further, the magnetic shield 5 has a skirt 26 at its screen side, which skirt follows the contour of the shadow mask at least along the short sides. This enlarges the iron cross-section of the shield.

I claim:

1. In a color display tube comprising:

(a) an envelope having a neck portion, a funnel portion and a window portion disposed along a longitudinal axis;

(b) an electron gun arranged in said neck portion;

(c) an elongated display screen disposed at an inner surface of said window portion, said display screen having an aspect ratio $\alpha$, and said display screen having a pattern of phosphor rows parallel to an axis of said display screen;

(d) color selection means arranged adjacent to said display screen;

(e) an internal magnetic shield arranged within said funnel portion between said electron gun and said color selection means, said magnetic shield having two long walls parallel to a long axis of said elongated display screen and two short side walls parallel to a short axis of said elongated display screen, and said magnetic shield having an oblong scanning aperture adjacent to said electron gun for passing electron beams scanning said display screen, said scanning aperture being transverse to said longitudinal axis;

the improvement comprising said scanning aperture extending to each of said two side walls to provide an oversized aperture having a pair of diametrically extreme angular points at each of said two side walls, said oversized aperture having a long central axis a and a short central axis b, where $$1.5 \leqq 1/\alpha \times a/b \leqq 1.75.$$

2. A color display tube according to claim 1, wherein said scanning aperture widens laterally at portions providing said pair of diametrically extreme angular points.

3. A color display tube according to claim 1, wherein said scanning aperture widens along diagonals of said scanning aperture into said side walls of said magnetic shield.

4. A color display tube according to claim 1, wherein said scanning aperture merges into fishtail-shaped apertures extending into each of said side walls of said magnetic shield.

5. A color display tube according to claim 4, wherein said magnetic shield has a central dimension between said aperture and an edge of said magnetic shield substantially equal to a dimension between an end of each of said two diametrically extreme angular points of said oversized aperture and oppositely located edges of said magnetic shield.

6. A color display tube according to claim 1, wherein said magnetic shield is of a material having a thickness $d \geqq 1/4D \times 10^{-3}$ mm, where D is a picture diagonal of said display screen.

7. A color display tube according to claim 1, wherein said magnetic shield is of a material having a magnetic coercive force $Hc \leqq 170$ A/m.

* * * * *